US006395968B1

(12) United States Patent
Minakuchi

(10) Patent No.: US 6,395,968 B1
(45) Date of Patent: May 28, 2002

(54) STRINGED MUSICAL INSTRUMENT HAVING HEAD COVERED WITH BRIGHT PANEL AND PROCESS OF FABRICATION THEREOF

(75) Inventor: Kiyoshi Minakuchi, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/640,308

(22) Filed: Aug. 16, 2000

(30) Foreign Application Priority Data

Aug. 20, 1999 (JP) ..... 11-234332

(51) Int. Cl.[7] ..... G10D 3/00
(52) U.S. Cl. ..... 84/290; 84/293
(58) Field of Search ..... 84/290, 291, 293, 84/267, 294

(56) References Cited

U.S. PATENT DOCUMENTS 4,362,079 A * 12/1982 Kelly ..... 84/291
4,916,995 A * 4/1990 Soler et al. ..... 84/29
4,989,491 A * 2/1991 Baggs ..... 84/723
5,218,149 A * 6/1993 Tanaka et al. ..... 84/291
5,333,527 A * 8/1994 Janes et al. ..... 84/291
5,661,252 A * 8/1997 Krawczak ..... 84/291
6,011,205 A * 1/2000 Tucker et al.
6,034,310 A * 3/2000 Kolano ..... 84/293
6,037,532 A * 3/2000 Beckmeir ..... 84/293
6,069,306 A * 5/2000 Isvan et al. ..... 84/267
6,087,568 A * 7/2000 Seal ..... 84/193

FOREIGN PATENT DOCUMENTS

JP 52-154228 11/1977
JP 52-154229 11/1977

OTHER PUBLICATIONS

Guitar Gear, p. 250 91985) GPI publications.*

* cited by examiner

*Primary Examiner*—Robert E. Nappi
*Assistant Examiner*—Kim Lockett
(74) *Attorney, Agent, or Firm*—Dickstein Shapiro Morin & Oshinsky LLP

(57) ABSTRACT

An acoustic guitar is broken down into a body, a neck and a head, and the neck and the head are differently finished, wherein a panel already coated with paint for bright finish is attached to an incomplete head formed at the heading end of the neck, which has been already treated with oil so that any mask is not required in the finishing work.

46 Claims, 6 Drawing Sheets

STRINGED MUSICAL INSTRUMENT HAVING HEAD COVERED WITH BRIGHT PANEL AND PROCESS OF FABRICATION THEREOF

FIELD OF THE INVENTION

This invention relates to a stringed musical instrument and, more particularly, to a stringed musical instrument with a head formed at the leading end of a neck and a process for fabricating the stringed musical instrument.

DESCRIPTION OF THE RELATED ART

A musician plays the stringed musical instrument by bowing or plucking. In either case, strings are stretched over a neck, and are anchored at a head and a body. Thus, the body, neck, head and strings are indispensable component parts of the stringed musical instrument.

FIG. 1 illustrates a typical example of an acoustic guitar. The acoustic guitar is categorized in the stringed musical instrument. The prior art acoustic guitar is broken down into a body 1, a neck 3, a head 4 and six strings 5. Several boards 2 are assembled together, and a resonator is defined inside of the body 1. The resonator is open through a sound hole to the outside of the body 1. A tailpiece 1*a* is attached to the front board 2 of the body 1, and is located on one side of the sound hole.

The neck 3 is fixed to the body 1, and projects from the other side of the body 1. The neck 3 includes a neck beam fixed to the body 1, a fingerboard 6 attached to the upper surface of the neck beam and frets 7 partially embedded in the fingerboard 6 at intervals. The fingerboard 6 extends from the neck beam onto the front board 2 of the body 1. The head 4 is formed at the leading end of the neck beam, and the neck beam and the head 4 are formed in a monolithic body. Pegs 8 are attached to the head 4, and are rotatable with respect to the head 4. The six strings 5 are stretched between the pegs 8 and the tailpiece 1*a*. The six strings 5 extend over the fingerboard 6 and the front board 2, and pass over the sound hole.

FIG. 2 illustrates the monolithic body for the neck beam 3*a* and the head 4. The fingerboard 6 is bonded to a part of the monolithic body serving as the neck beam 3*a*, and the head 4 is uncovered with the fingerboard 6. Six peg holes are formed in the head 4, and are respectively assigned to the pegs 8.

A wood plate is shaped into the monolithic body, and the peg holes are formed in the monolithic body. Upon completion of the wood machine work, the fingerboard 6 is bonded to the neck beam 3*a* of the monolithic body, and, thereafter, the monolithic body is finished. The fingerboard 6 is usually not painted from viewpoints of good appearance and fine finger touch. The exposed surface of the neck beam 3*a* is painted for frost finishing, or is treated with oil. On the other hand, the head 4 is painted for bright finish.

In order to differently finish the monolithic body 3*a*/4 and the fingerboard 6, a masking work is required. In detail, the painter masks the fingerboard 6 and the head 4 with a piece of masking sheet, and the exposed surface of the neck beam 3*a* is painted for the frost finishing. Subsequently, the masking sheet is removed from the head 4, and the frosted surface of the neck beam 3*a* is masked with a piece of masking sheet. The head 4 is painted for the bright finishing, and, thereafter, the painted surface is polished with a buff. Thus, the neck 3 and the head 4 are finished through the complicated process sequence, and a large amount of time and labor is consumed for the finishing process. This results in a great production cost.

SUMMARY OF THE INVENTION

It is therefore an important object of the present invention to provide a stringed musical instrument, which makes the production cost low.

It is also an important object of the present invention to provide a process through which the stringed musical instrument is fabricated.

To accomplish the object, the present invention proposes to assemble a monolithic body with a decorative board.

In accordance with one aspect of the present invention, there is provided a stringed musical instrument comprising a body, at least one string anchored at one end thereof to the body and vibratory for generating sound variable in pitch, a neck projecting from the body and having a front surface over which the at least one string is stretched and another surface treated through a first kind of finishing, and a head connected to a leading end of the neck and having a bulk portion, a panel attached to the bulk portion and treated through a second kind of finishing different from the first kind of finishing and an anchoring means to which the other end of the at least one string is anchored.

In accordance with another aspect of the present invention, there is provided a process for fabricating a stringed musical instrument comprising the steps of a) preparing a composite component part including a neck having a front surface and another surface treated through a first kind of finishing and an incomplete head connected to a leading end of the neck and a panel treated through a second kind of finishing different from the first kind of finishing, b) fixing the panel to the incomplete head of the composite component part, and c) completing the stringed musical instrument on the basis of the resultant structure in the step b).

BRIEF DESCRIPTION OF THE DRAWINGS

The features and advantages of the stringed musical instrument and the process will be more clearly understood from the following description taken in conjunction with the accompanying drawings in which.

DESCRIPTION OF THE PREFERRED EMBODIMENTS

Structure of Stringed Musical Instrument

Figure 3:
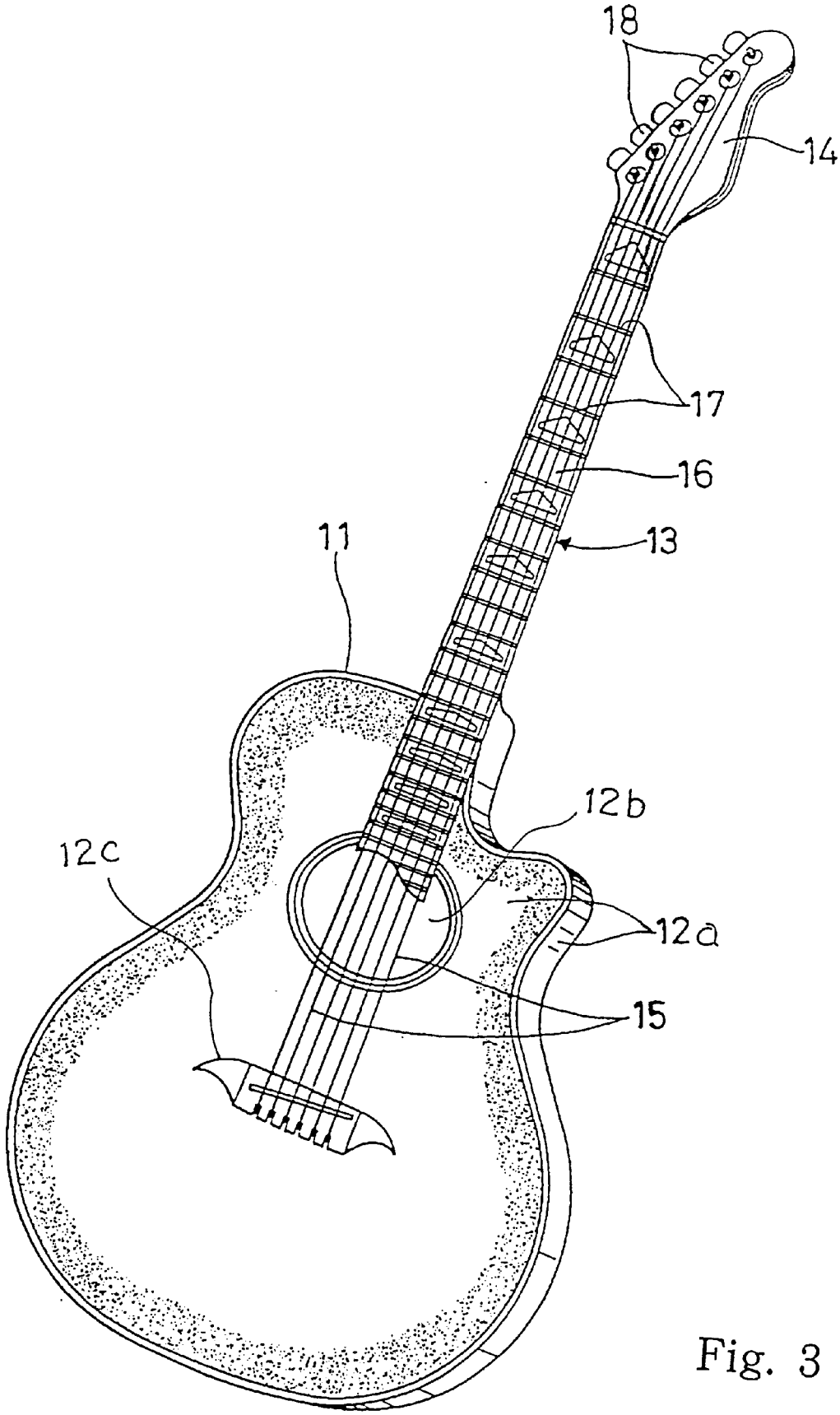
FIG. 3 is a perspective view showing an acoustic guitar according to the present invention.

Referring to FIG. 3 of the drawings, an acoustic guitar embodying the present invention largely comprises a body 11, a neck 13, a head 14 and six strings 15. The body 11 is a generally gourd-shaped, and, accordingly, has a large round portion and a small round portion. Several wooden boards 12*a* are appropriately shaped, and are assembled into the body 11. A hollow space is defined inside of the body 11, and serves as a resonator. A sound hole 12*b* is formed in the front board 12*a*, and the resonator is open through the sound hole 12*b* to the outside of the body 11. The sound hole 12*b* is formed in the boundary between the large round portion and the small round portion. In the following description, the end surface of the small round portion is referred to as "front" end surface, and the end surface of the large round portion is referred to as "rear" end surface. Thus, terms "front" and "rear" are used to indicate a relative position. The body 11 has a tail piece 12*c*, which is attached to the rear portion of the front board 12*a*.

Figure 1:
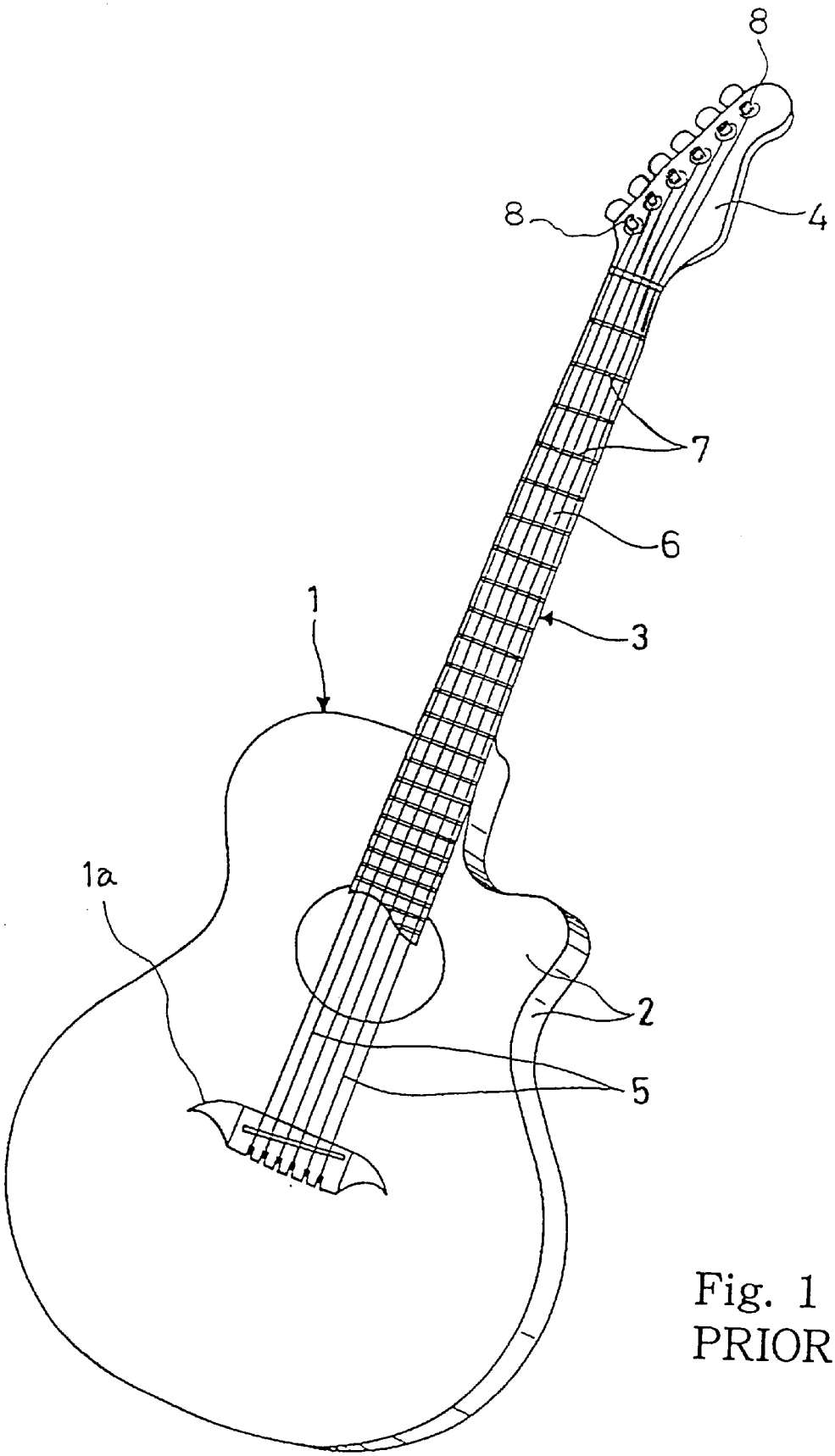
Fig. 1 PRIOR ART
FIG. 1 is a perspective view showing the prior art acoustic guitar.
Figure 2:
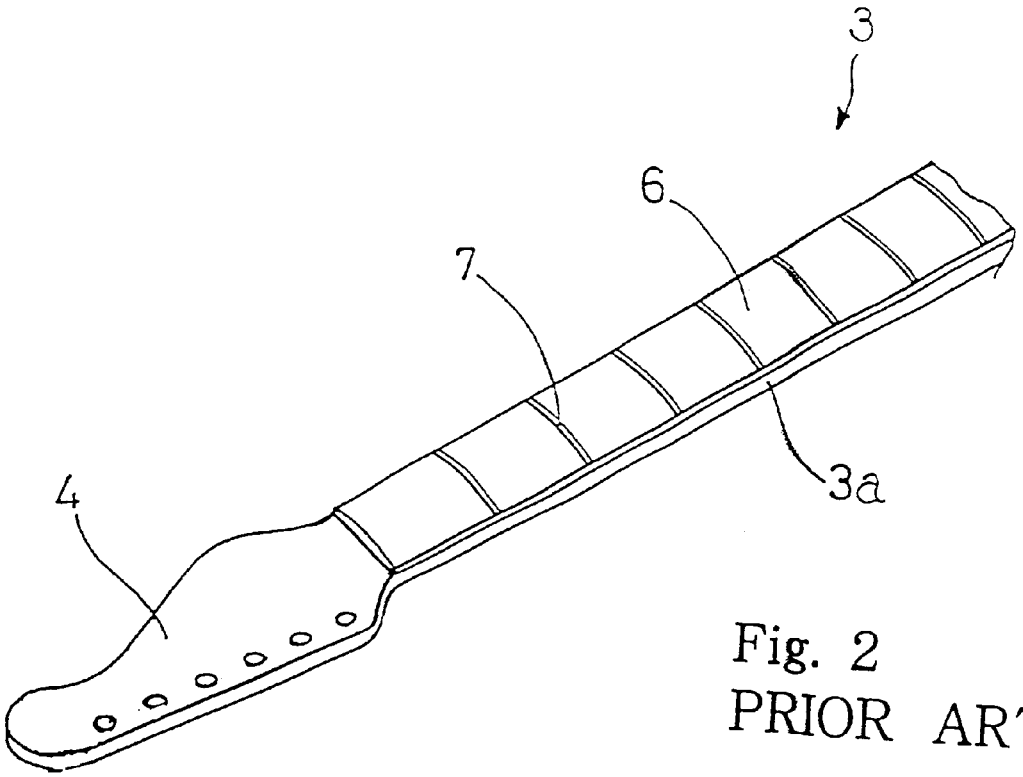
Fig. 2 PRIOR ART
FIG. 2 is a perspective view showing the monolithic body for the neck beam and the head both incorporated in the prior art acoustic guitar.
Figure 4:
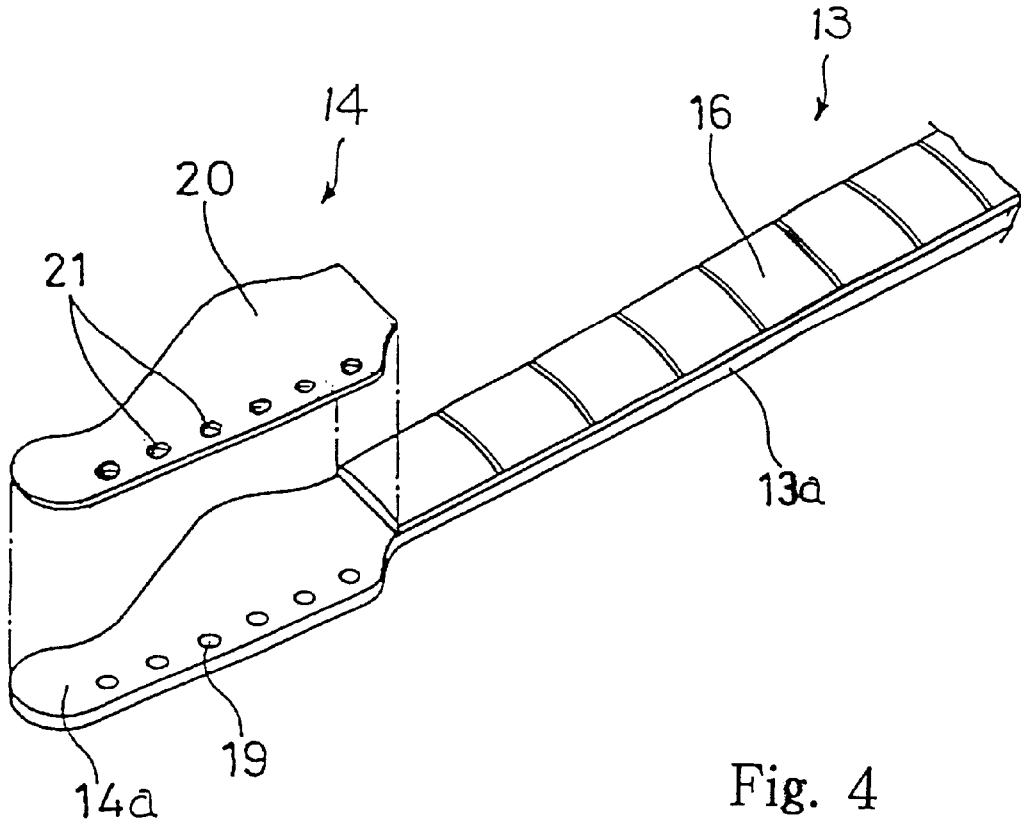
FIG. 4 is a perspective view showing a monolithic body for a neck and a head both incorporated in the acoustic guitar.

A monolithic body is used for the neck 13 and head 14. The monolithic body is partially used as a neck beam 13*a* and partially as a bulk portion 14*a* (see FIG. 4). The monolithic body is adhered to the small round portion of the body 11, and frontward projects from the front end surface. A fingerboard 16 is attached to the front surface of the neck body 13*a*, and forms the neck 13 together with the neck beam 13. Frets 17 are embedded in the fingerboard 16 at intervals. The fingerboard 16 rearward extends from the neck beam 13*a* onto the front board 12*a*, and the sound hole 12*b* is partially overlapped with the fingerboard 16. The fingerboard 16 is not painted because of good appearance and fine finger touch when a player presses the strings 15 thereto. On the other hand, the neck beam 13*a* and the bulk portion 14*a* are painted for frost frosted surface or treated with oil except a front surface of the head 14.

On the other hand, a decorative panel 20 is adhered to the front surface of the bulk portion 14*a*. The decorative panel 20 is painted for the bright finish. Thus, the fingerboard 16, the monolithic body 13*a*/14*a* and the decorative panel 20 are differently finished. Peg holes 19 are formed in the bulk portion 14*a*, and corresponding holes 21 are formed in the decorative panel 20. Pegs 18 have respective winding portions, and the winding portions are exposed to the peg holes 19/21 (see FIG. 3). The winding portions are bi-directionally rotated when a player manipulates knobs. The knobs form parts of the pegs 18, and projects from a side surface of the head 14.

The strings 15 are stretched between the pegs 18 and the tail piece 12*c*. The strings 15 extend over the fingerboard 16 and the sound hole 12*b*. Although the strings 15 are held in contact with the fret closest to the head 14, the strings 15 are slightly spaced from the other frets 17. A player selectively presses the strings 15 to the fingerboard 16 between the frets 17 with the fingers so as to change the pitch of guitar sound depending upon the fret 17 into which the vibrating string 15 is brought into contact.

Although the acoustic guitar according to the present invention is substantially identical in appearance with the prior art acoustic guitar, the acoustic guitar according to the present invention is lower in production cost than the prior art acoustic guitar by virtue of the usage of decorative panel 20.

Process

Figure 5A:
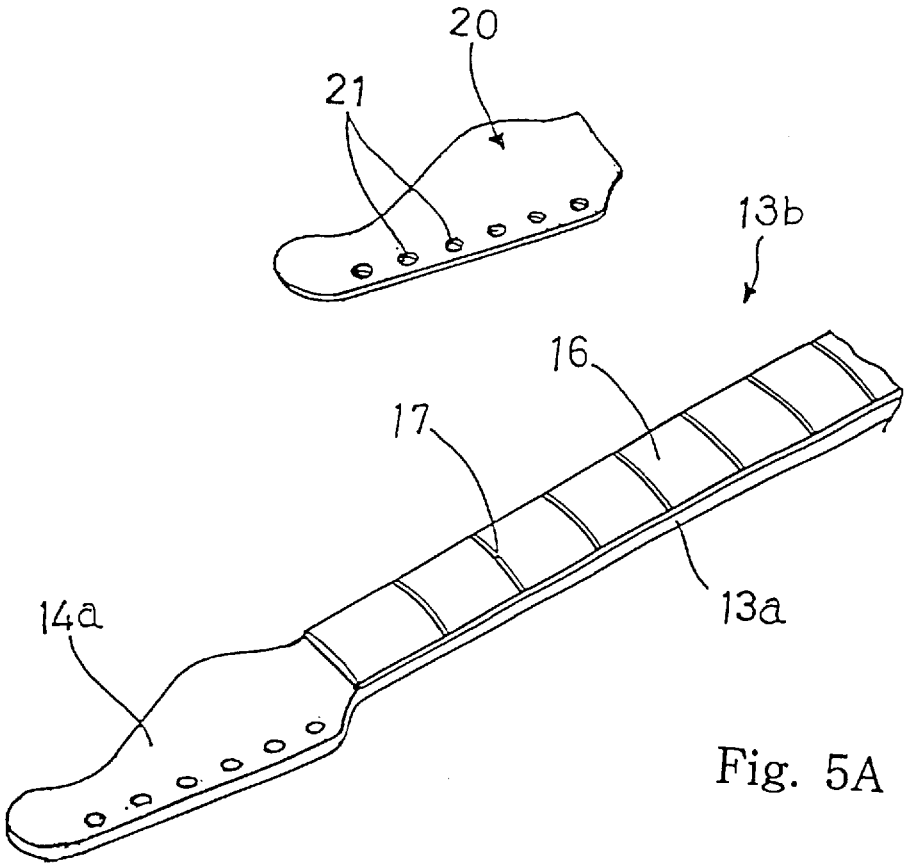
FIGS. 5A to 5C are perspective views showing essential steps of a process for fabricating the stringed musical instrument.
Figure 5B:
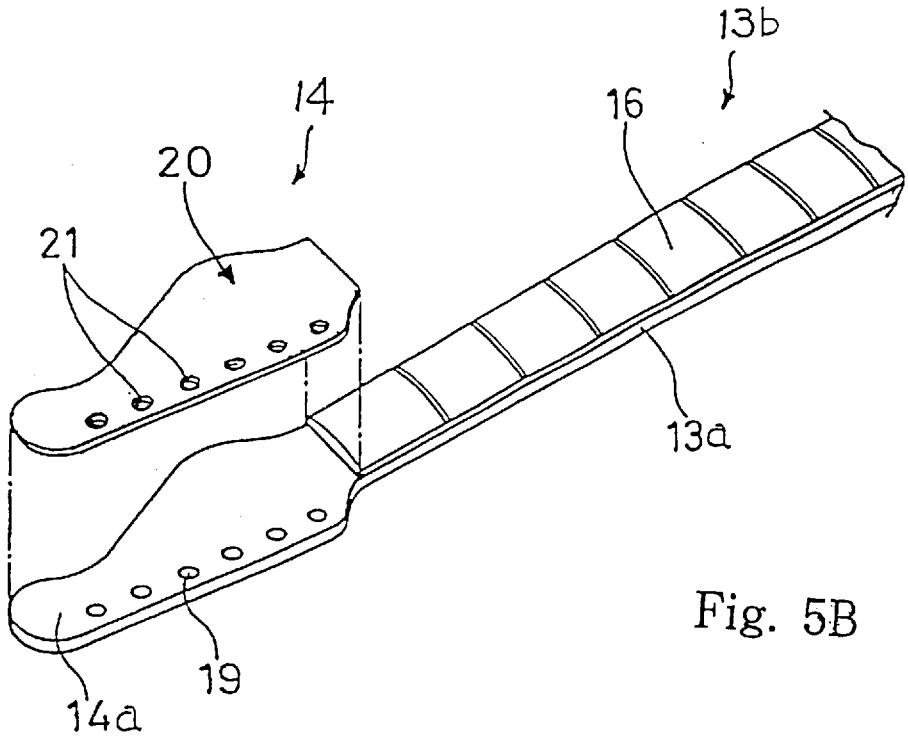
Figure 5C:
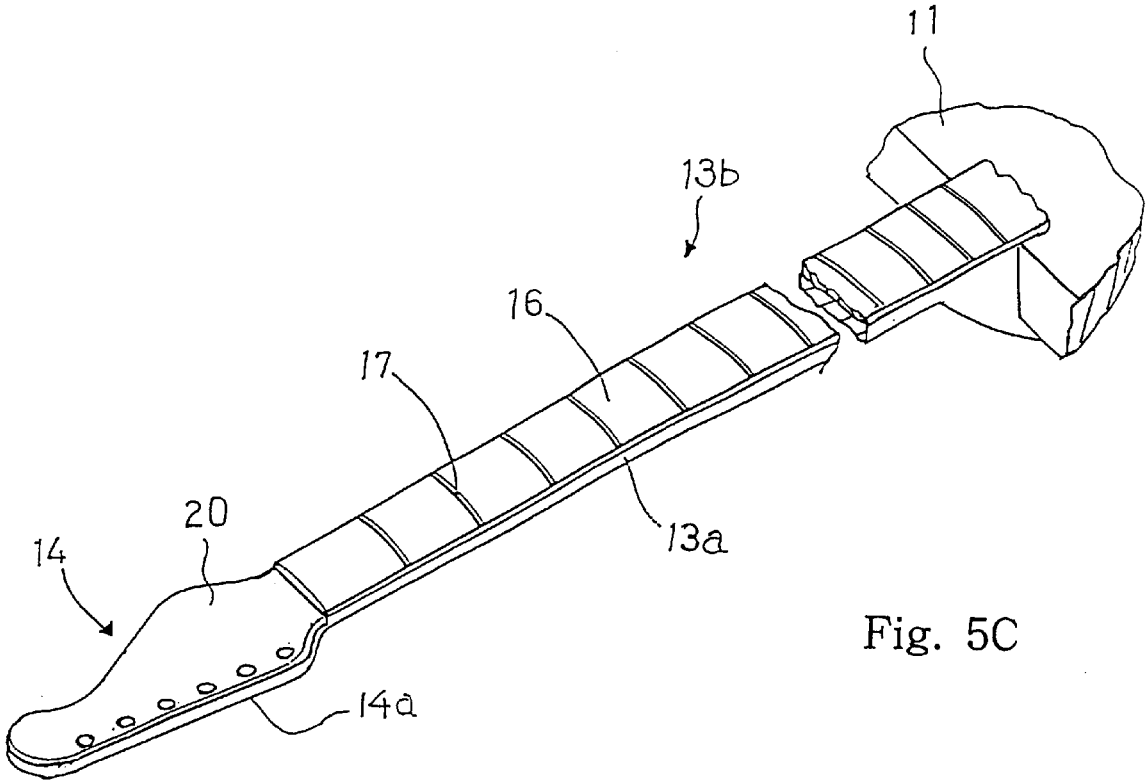

A process for fabricating the acoustic guitar is broken down into two steps, i.e., preparation of the body 11, a composite component part 13*b* and the decorative panel 20, assemblage of the decorative panel 20 with the composite component part 13*b* and completion of the acoustic as shown in FIGS. 5A to 5C.

In the first step, the wooden plates are shaped through wood working into the wooden boards 12*a*, and the wooden boards 12*a* are assembled into the body 11. A wooden plate is shaped into the monolithic body 13*a*/14*a*, and the fingerboard 16 is attached to the front surface of the neck beam 13*a*. The frets 17 have been already embedded in the fingerboard 16 at intervals. The fingerboard 16 and the front surface of the bulk portion 14*a* are coated with a mask, and the resultant structure is painted for a frosted surface or treated with oil. The mask prevents the front surface of the bulk portion 14*a* from the paint or oil.

Figure 6:
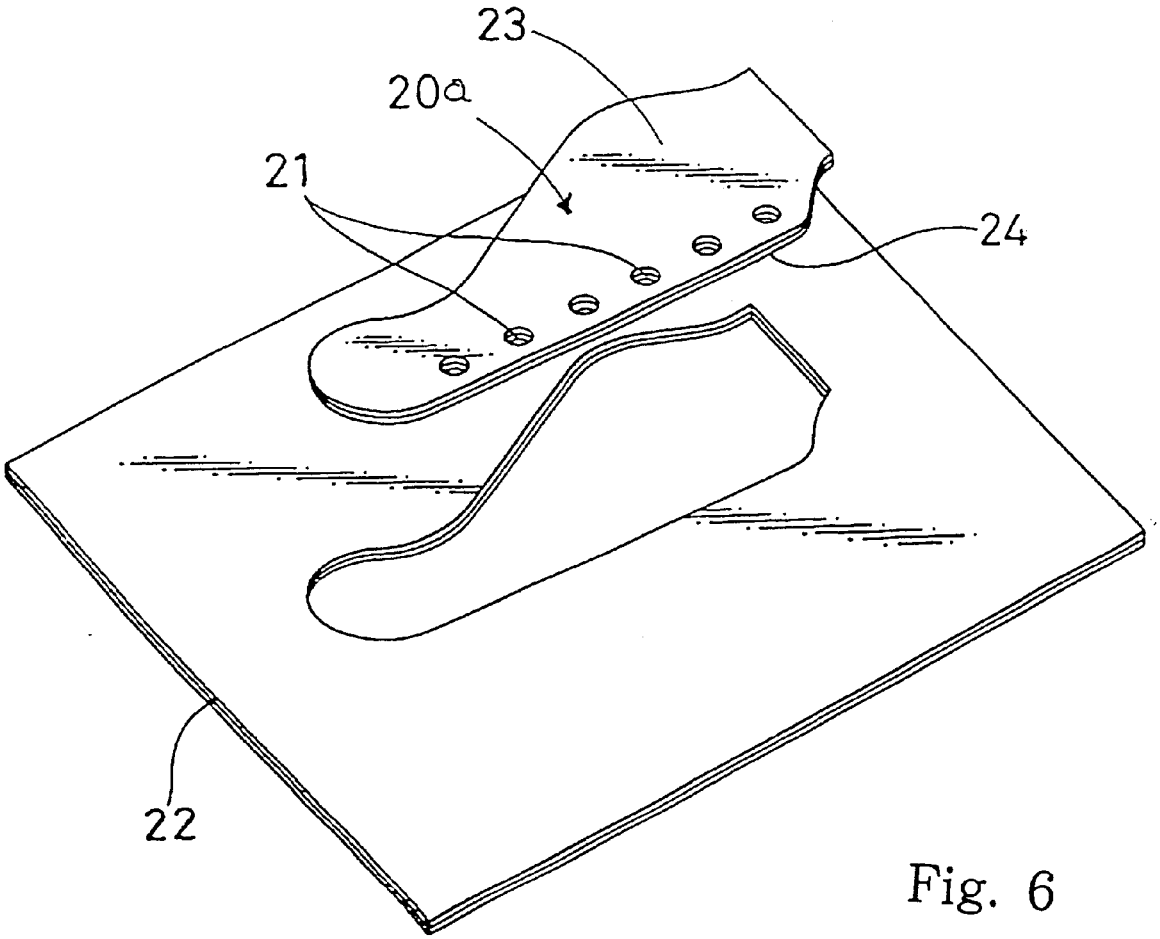
FIG. 6 is a perspective view showing a decorative panel cut from a laminated board.

On the other hand, the decorative panel 20 is prepared as follows. A sheet of plywood 22 is prepared, and a base panel 20*a* is cut from the sheet of plywood 22 as shown in FIG. 6. The sheet of plywood 22 is a lamination of a front layer 23 and a bottom layer 24. The front layer 23 is formed of wood such as, for example, maple, and the thickness is 0.2 millimeter to 1 millimeter. On the other hand, the bottom layer 24 is formed of wood or synthetic resin, and the thickness ranges from 1 millimeter to 1.5 millimeters. As a result, the total thickness of the plywood 22 is greater than 1.0 millimeters and less than 3.0 millimeters, and preferably ranges from 1.2 millimeters to 2.5 millimeters. If the sheet of plywood 22 is equal to or less than 1 millimeter thick, the base panel 20*a* is warped after painting. On the other hand, if the base panel 20*a* is equal to or greater than 3 millimeters thick, the side surface of the decorative panel 20 is clearly seen, and makes the appearance bad. The plywood 22 is effective against the warp after the painting. This is the reason why the base panel 20*a* is cut from the sheet of plywood 22. The front layer 23 provides a front surface to be painted. If the front layer 23 and/or the bottom layer 24 is formed of different material, the manufacturer can reduce the total thickness.

In order to cut the base panel 20*a* from the sheet of plywood 22, the sheet of plywood 22 is placed in a die (not shown), and is punched. Then, the base panel 20*a* is cut from the sheet of plywood 22. Otherwise, the base panel 20*a* is cut from the sheet of plywood 22 by using a numerical controlled rooter (not shown). The base panel 20*a* is finished or ground by using a piece of sand paper, and, thereafter, is painted. Paint is sprayed onto the base plate 20*a*. Finally, the painted base plate 20*a* is polished with a buff.

Figure 7:
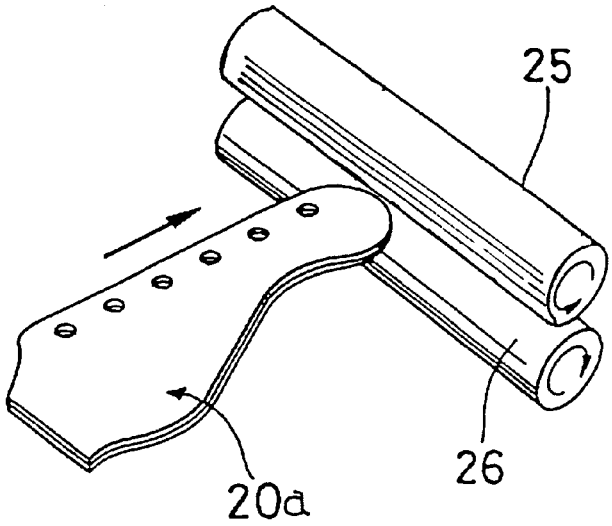
FIG. 7 is a perspective view showing the decorative board in a finishing step.

The manufacturer may pass the base panel 20*a* between a pair of rollers 25/26 as shown in FIG. 7. The rollers 25/26 are full of the paint, and are rotatable as indicated by arrows. While the base panel 20*a* is passing between the rollers 25 and 26, the base panel 20*a* is coated with paint. The paint is as thin as 200 microns to 400 microns. Otherwise, the manufacturer may coat the base panel 20*a* with synthetic resin by using an injection molding machine. In detail, the base panel 20*a* is put in a molding die, and melted synthetic resin is injected into the molding die. Then, the base panel 20*a* is coated with the synthetic resin. The synthetic resin ranges from 500 microns to 800 microns thick and, preferably, from 200 microns to 400 microns thick. The base panel 20 for the injection molding may be 2.0 millimeters thick, i.e., the front layer 23 is 0.5 millimeter thick and the bottom layer 24 is 1.5 millimeters thick, and the synthetic resin may be transparent.

Although the above-description is firstly made on the body 11, then on the composite component part 13*b* and finally on the decorative panel, the body 11, the manufacturer may form the composite component part 13*b* and the decorative panel 20 in another order different from the order of description. It is necessary to prepare the body 11, the composite component part 13*b* and the decorative panel 20 at the end of the first step.

Upon completion of the body 11, the composite component part 13*b* and the decorative panel 20, the process sequence proceeds to the second step shown in FIG. 5B. The decorative panel 20 is bonded to the front surface of the bulk portion 14*a* by using adhesive compound. Otherwise, adhesive double coated tape is used between the front surface of the bulk portion 14*a* and the decorative panel 20. A kind of adhesive double coated tape allows the decorative panel 20 to peel off from the bulk portion 14*a*. When the decorative panel 20 is cracked or damaged, the user easily replaces the cracked decorative panel 20 with a new decorative panel 20. The decorative panel 20 may be bolted to the bulk portion 14*a*.

Upon completion of the attachment of the decorative panel 20 to the bulk portion 14*a*, the process sequence proceeds to the final step. Namely, the composite component part 13*b* is adhered to the front end portion of the body 11 as shown in FIG. 5C. The pegs 18 are attached to the head 14, and the strings 15 are stretched between the pegs 18 and the tail piece 12*c*.

In the above-described embodiment, the painting for the frosted surface and the treatment with oil are corresponding to the first kind of finishing, and the painting for bright finish is corresponding to the second kind of finishing.

As will be understood from the foregoing description, the body, the composite component part 13*b* and the decorative panel 20 are separately prepared before the assembling step. Any mask is not required for the different finishing between the decorative panel 20 and the composite component part 13*b*, and the manufacturer easily automates the production of the decorative panel 20. This results in enhancement of the productivity and, accordingly, reduction of the production cost.

Moreover, the manufacturer produces various kinds of decorative panels 20 and the composite component parts 13*b*, and stocks them until customer's order. The manufacturer can deliver the product after the assemblage. Thus, the process according to the present invention allows the manufacturer to reduce the time period from the order to the delivery.

Finally, the manufacturer can prepare the decorative panels 20 different in color, pattern and material before the assembling step, and attaches one of the decorative panels 20 to the bulk portion 14*a* depending upon user's demand. As a result, the manufacturer offers a wide variety of products to the user.

Although a particular embodiment of the present invention has been shown and described, it will be apparent to those skilled in the art that various changes and modifications may be made without departing from the spirit and scope of the present invention.

For example, the present invention is applicable to any kind of stringed musical instrument in so far as the musical instrument has a neck and a head. If the present invention is applied to an electric guitar, the body is solid.

What is claimed is:

1. A stringed musical instrument comprising a body, at least one string anchored at one end thereof to said body and vibratory for generating sound variable in pitch, a neck projecting from said body and having a front surface over which said at least one string is stretched and another surface treated through a first kind of finishing, and a head connected to a leading end of said neck and having a bulk portion, a panel which is permanently attached to said bulk portion and treated through a second kind of finishing which is different from said first kind of finishing and an anchoring means to which the other end of said at least one string is anchored.

2. The stringed musical instrument as set forth in claim 1, in which a monolithic body is shared between said neck and said head, and said panel is attached to a leading end portion of said monolithic body.

3. The stringed musical instrument as set forth in claim 1, in which said neck further has a fingerboard differently finished from said another surface and said panel.

4. The stringed musical instrument as set forth in claim 3, in which said fingerboard and said panel are attached to a first area and a second area of a monolithic body shared between said neck and said head and connected to said body.

5. The stringed musical instrument as set forth in claim 3, in which said neck further has plural frets embedded in said fingerboard at intervals.

6. The stringed musical instrument as set forth in claim 1, in which a resonator is formed in said body so as to acoustically make said sound loud.

7. The stringed musical instrument as set forth in claim 1, in which said first kind of finishing and said second kind of finishing are a treatment with oil and a painting for bright finishing, respectively.

8. The stringed musical instrument as set forth in claim 1, in which said panel is formed of plywood.

9. The stringed musical instrument as set forth in claim 8, in which said plywood has a relatively thick wooded layer and a relatively thin wooden layer laminated on said relatively thick wooded layer.

10. The stringed musical instrument as set forth in claim 8, in which said plywood has a relatively thick layer formed of synthetic resin and a relatively thin wooded layer laminated on said relatively thick layer.

11. The stringed musical instrument as set forth in claim 8, in which said plywood is greater in thickness than 1 millimeter and less in thickness than 3 millimeters.

12. A process for fabricating a stringed musical instrument, comprising the steps of:

a) preparing a composite component part including a neck having a front surface and another surface treated through a first kind of finishing and an incomplete head connected to a leading end of said neck, and a panel treated through a second kind of finishing different from said first kind of finishing;

b) permanently fixing said panel to said incomplete head of said composite component part; and c) completing said stringed musical instrument on the basis of the resultant structure in said step b).

13. The process as set forth in claim 12, in which said step a) includes the sub-steps of a-1) cutting a base panel from a board, a-2) treating said base panel through said second kind of finishing, and a-3) polishing the resultant structure for obtaining said panel.

14. The process as set forth in claim 13, in which said step a) further includes the sub-step of grinding said base plate by using a piece of sand paper between said sub-step a-1) and said sub-step a-2).

15. The process as set forth in claim 13, in which said second kind of finishing is a kind of painting.

16. The process as set forth in claim 15, in which paint is sprayed to said base plate.

17. The process as set forth in claim 16, in which said base plate is painted by passing it through rollers containing paint.

18. The process as set forth in claim 12, in which said step a) includes the sub-steps of a-1) cutting a base plate from a board, a-2) placing said base plate in a die, and a-3) injecting melted synthetic resin into said die so as to coat said base plate with the synthetic resin.

19. The process as set forth in claim 18, in which the layer of said synthetic resin ranges from 200 microns thick to 400 microns thick.

20. The process as set forth in claim 12, in which said panel is bonded to said incomplete head by means of adhesive compound.

21. A stringed musical instrument comprising a body, at least one string anchored at one end thereof to said body and vibratory for generating sound variable in pitch, said body having a resonator formed therein so as to acoustically make said sound loud, a neck projecting from said body and having a front surface over which said at least one string is stretched and a second surface treated through a first kind of finishing, and a head connected to a leading end of said neck and having a bulk portion, a panel attached to said bulk portion and treated through a second kind of finishing different from said first kind of finishing and an anchoring means to which the other end of said at least one string is anchored.

22. A stringed musical instrument comprising a body, at least one string anchored at one end thereof to said body and vibratory for generating sound variable in pitch, a neck projecting from said body and having a front surface over which said at least one string is stretched and a second surface treated through a first kind of finishing, and a head connected to a leading end of said neck and having a bulk portion, a panel attached to said bulk portion and treated through a second kind of finishing different from said first kind of finishing and an anchoring means to which the other end of said at least one string is anchored, said panel being formed of plywood in which said plywood has a relatively thick wooded layer and a relatively thin wooden layer laminated on said relatively thick wooded layer.

23. A stringed musical instrument comprising a body, at least one string anchored at one end thereof to said body and vibratory for generating sound variable in pitch, a neck projecting from said body and having a front surface over which said at least one string is stretched and a second surface treated through a first kind of finishing, and a head connected to a leading end of said neck and having a bulk portion, a panel attached to said bulk portion and treated through a second kind of finishing different from said first kind of finishing and an anchoring means to which the other end of said at least one string is anchored, said panel being formed of plywood in which said plywood has a relatively thick layer formed of synthetic resin and relatively thin wooden layer laminated on said relatively thick layer.

24. A process for fabricating a head and neck of a stringed musical instrument, said process comprising:

(a) applying a first finish to at least one surface of a composite part including a neck section and a head section;

(b) applying a second finish, different than the first finish, to at least a top surface of a panel;

(c) permanently affixing the panel to the head section of the composite part with the top surface exposed.

25. The process as set forth in claim 24, wherein the second finish is a painted finish.

26. The process as set forth in claim 25, wherein the paint is sprayed onto at least the top surface of the panel.

27. The process as set forth in claim 25, wherein the paint is applied to at least the top surface of the panel by passing the panel between a pair of rollers.

28. The process as set forth in claim 24, wherein the panel is first cut from a board and placed in a die and wherein the first finish is formed by injecting a synthetic resin into the die so as to coat the panel with the synthetic resin.

29. The process as set forth in claim 28, wherein the layer of synthetic resin ranges from 200 microns thick to 400 microns thick.

30. The process as set forth in claim 24, wherein the panel is permanently affixed to the head section using an adhesive.

31. The process as set forth in claim 24, further including attaching a fingerboard to the neck section.

32. The process as set forth in claim 31, wherein a third finish, which is different than the second finish, is applied to at least a portion of the fingerboard.

33. The process as set forth in claim 24, further including attaching the neck to a body portion of the stringed musical instrument.

34. A stringed musical instrument, comprising:

a body;

a neck projecting from the body and including a top surface and another surface, at least the another surface being treated with a first finishing treatment;

a head connected to the neck and including a support surface;

a panel having a top surface which is treated with a second finishing treatment which is different than the first finishing treatment, the panel being permanently affixed to the support surface of the head with the top surface exposed; and a plurality of strings coupled between the head and the body and extending over the neck of the musical instrument.

35. The musical instrument as set forth in claim 34, wherein a monolithic body is shared by the head and the neck.

36. The musical instrument as set forth in claim 35, wherein the monolithic body is coupled to the body.

37. The musical instrument as set forth in claim 34, wherein a fingerboard is attached to the top surface of the neck.

38. The musical instrument of claim 37, wherein the fingerboard is treated with a finishing treatment which is different than the second finishing treatment.

39. The musical instrument of claim 38, wherein the fingerboard includes a plurality of frets.

40. The musical instrument of claim 34, wherein a resonator cavity is formed in the body so as to amplify sounds made by the strings.

41. The musical instrument of claim 34, wherein the first and second finishing treatments are a treatment with oil and painting respectively.

42. The musical instrument of claim 34, wherein the panel is formed of plywood.

43. The musical instrument of claim 42, wherein the panel includes a first wood layer and a second wood layer laminated on the first wood layer, the first wood layer being thicker than the second wood layer.

44. The musical instrument of claim 42, wherein the thickness of the panel is greater than 1 millimeter and less than 3 millimeters.

45. The musical instrument of claim 34, wherein the neck includes bottom and side surfaces which are treated with the first finishing treatment, the bottom surface defining the another surface of the neck.

46. A stringed musical instrument comprising a body;

at least one string anchored at one end thereof to said body and vibratory for generating sound variable in pitch;

a neck projecting from said body and having a front surface over which said at least one string is stretched and another surface treated with a first finishing agent for achieving a first kind of finishing; and a head connected to a leading end of said neck and having a bulk portion, a panel which is permanently attached to said bulk portion and treated with a second finishing agent different from said first finishing agent for achieving a second kind of finishing which is different from said first kind of finishing and an anchoring means to which the other end of said at least one string is anchored.

* * * * *